US009697924B2

(12) United States Patent
Nanni et al.

(10) Patent No.: US 9,697,924 B2
(45) Date of Patent: Jul. 4, 2017

(54) COHERENT ELECTRON AND RADIATION PRODUCTION USING TRANSVERSE SPATIAL MODULATION AND AXIAL TRANSFER

(71) Applicant: Massachusetts Institute of Technology, Cambridge, MA (US)

(72) Inventors: Emilio Alessandro Nanni, Cambridge, MA (US); William Sproull Graves, Marblehead, MA (US); Franz Xaver Kaertner, Newton, MA (US); David Eugene Moncton, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 162 days.

(21) Appl. No.: 14/674,482

(22) Filed: Mar. 31, 2015

(65) Prior Publication Data

US 2016/0307659 A1 Oct. 20, 2016

Related U.S. Application Data

(60) Provisional application No. 61/973,692, filed on Apr. 1, 2014.

(51) Int. Cl.

| | |
|---|---|
| ***G21K 5/00*** | (2006.01) |
| ***G21K 1/06*** | (2006.01) |
| ***H01J 23/18*** | (2006.01) |
| ***H05G 2/00*** | (2006.01) |

(52) U.S. Cl.

CPC ..... *G21K 5/00* (2013.01); *G21K 1/06* (2013.01); *H01J 23/18* (2013.01); *H05G 2/00* (2013.01)

(58) Field of Classification Search

CPC ..... H05G 2/00; H05G 2/008; H05H 7/001; H01S 3/0903; G21K 5/00; G21K 1/06; H01J 35/00

See application file for complete search history.

(56) References Cited

U.S. PATENT DOCUMENTS

| | | | | |
|---|---|---|---|---|
| 5,956,353 | A * | 9/1999 | Nguyen | H01S 3/0903 372/2 |
| 6,333,966 | B1 * | 12/2001 | Schoen | G21K 1/003 378/119 |
| 7,310,408 | B2 * | 12/2007 | Filkins | H05G 2/00 378/119 |

(Continued)

OTHER PUBLICATIONS

Nanni, Emilio A., William S. Graves, and David E. Moncton. "Nano-modulated electron beams via electron diffraction and emittance exchange for coherent x-ray generation." arXiv preprint arXiv:1506.07053 (2015).*

(Continued)

*Primary Examiner* — Wyatt Stoffa

(74) *Attorney, Agent, or Firm* — Modern Times Legal; Robert J. Sayre

(57) ABSTRACT

Coherent electronic current is generated by generating and transmitting an electron bunch along a longitudinal axis. The electron bunch is then directed onto a target, wherein the target imparts a transverse spatial modulation to the electron bunch via diffraction contrast or phase contrast. The transverse spatial modulation of the electron bunch is then transferred to the longitudinal axis via an emittance exchange beamline, creating a periodically modulated distribution of coherent electronic current.

22 Claims, 4 Drawing Sheets

(56) References Cited

U.S. PATENT DOCUMENTS

| | | | | |
|---|---|---|---|---|
| 7,391,850 | B2 | 6/2008 | Kaertner et al. | |
| 8,787,529 | B2 * | 7/2014 | Graves | H05G 2/00 250/493.1 |
| 2005/0226383 | A1 * | 10/2005 | Rifkin | G02B 5/10 378/119 |
| 2012/0288065 | A1 * | 11/2012 | Graves | H05G 2/00 378/119 |
| 2015/0285749 | A1 * | 10/2015 | Moncton | H05G 2/00 378/86 |

OTHER PUBLICATIONS

M. Bech, et al., "Hard X-ray phase-contrast imaging with the Compact Light Source based on inverse Compton X-rays", 16 J. Synchrotron Radiation 43-47 (2009).

M. Cornacchia, et al., "Transverse to longitudinal emittance exchange", 5 Physical Review Special Topics—Accelerators and Beams 084001 (2002).

P. Sprangle, "Laser-pumped coherent x-ray free-electron laser", 12 Physical Review Special Topics—Accelerators and Beams 050702 (2009).

W.S. Graves, et al., "Compact x-ray source based on burst-mode inverse Compton scattering at 100 kHz", 17 Physical Review Special Topics—Accelerators and Beams 120701 (Dec. 2014).

W.J. Brown, et al., "Three-dimensional time and frequency-domain theory of femtosecond x-ray pulse generation through Thomson Scattering", 7 Physical Review Special Topics—Accelerators and Beams 060703 (2004).

W.S. Graves, et al., "Intense Super-radiant X-rays from a Compact Source using a Nanocathode Array and Emittance Exchange", 108 Phys. Rev. Lett. 263904 (2012).

US Patent and Trademark Office, International Search Report and Written Opinion for PCT/US15/23612 (corresponding PCT application) (Dec. 29, 2015).

* cited by examiner

COHERENT ELECTRON AND RADIATION PRODUCTION USING TRANSVERSE SPATIAL MODULATION AND AXIAL TRANSFER

RELATED APPLICATION

This application claims the benefit of U.S. Provisional Application No. 61/973,692, filed 1 Apr. 2014, the entire content of which is incorporated herein by reference.

GOVERNMENT SUPPORT

This invention was made with government support under Contract No. N66001-11-1-4192 awarded by the Space and Naval Warfare Systems Center. The Government has certain rights in the invention.

BACKGROUND

Existing methods of x-ray generation include (1) bremsstrahlung x-rays from a tube, (2) inverse Compton scattering in either a small linear accelerator (LINAC) [W. S. Graves, J. Bessuille, P. Brown, S. Carbajo, V. Dolgashev, K.-H. Hong, E. Ihloff, B. Khaykovich, H. Lin, K. Murari, E. A. Nanni, G. Resta, S. Tantawi, L. E. Zapata, F. X. Kärtner, and D. E. Moncton, "Compact x-ray source based on burst-mode inverse Compton scattering at 100 kHz," 17 Phys. Rev. ST Accel. Beams 120701 (2014)] or a small storage ring [M. Bech, O. Bunk, C. David, R. Ruth, J. Rifkin, R. Loewen, R. Feidenhans'l and F. Pfeiffer, "Hard X-ray phase-contrast imaging with the Compact Light Source based on inverse Compton X-rays," 16 J. Synchrotron Rad. 43-47 (2009)], and (3) large scientific facilities such as synchrotrons and x-ray free electron lasers.

Bremsstrahlung x-rays from a tube have low brightness, are not monochromatic except at fixed wavelengths, and are not coherent. While bremsstrahlung is the source of medical x-rays and is widely used for scientific work, it is many orders of magnitude less intense than the other sources. Inverse Compton scattering has demonstrated good performance but does not rely on coherent x-ray generation via a modulated beam and so it is orders of magnitude less efficient than the proposed method. Synchrotron and x-ray free electron laser facilities have the highest demonstrated x-ray performance but may cost in the range of $100 million to $1 billion and may have a size on the order of kilometers.

Some of the present inventors previously conceived of apparatus and methods for generating coherent radiation using an array of discrete electron beamlets from a nano-cathode array, as described in U.S. Pat. No. 8,787,529 B2 (W. Graves, F. Kaertner and D. Moncton, "Compact Coherent Current and Radiation Source," issued 22 Jul. 2014), which is herein incorporated by reference in its entirety.

SUMMARY

An apparatus and method for generating coherent electrons and radiation (e.g., x-ray radiation) are described herein, where various embodiments of the apparatus and methods may include some or all of the elements, features and steps described below.

In methods, described herein, coherent electronic current is generated by generating and transmitting an electron bunch along a longitudinal axis. The electron bunch is then directed onto a target, wherein the target imparts a transverse spatial modulation to the electron bunch via diffraction contrast or phase contrast. The transverse spatial modulation of the electron bunch is then transferred to the longitudinal axis via an emittance exchange beamline, creating a periodically modulated distribution of coherent electronic current.

In particular embodiment, the periodically modulated distribution of electronic current is directed into a stream of photons to generate coherent radiation. The stream of photons can have a periodic distribution matching that of the electronic current; and the coherent radiation can be generated by inverse Compton scattering of the electrons on a laser pulse. In additional embodiments, the coherent radiation can be generated by inverse Compton scattering of the electrons on a terahertz pulse. In particular embodiments, the coherent radiation can include x-ray radiation, gamma ray radiation, ultraviolet radiation, visible radiation, infrared radiation, and/or terahertz radiation.

Particular embodiments also include directing the periodically modulated distribution of electronic current into a static magnetic field (generated by magnet structure 25) to generate coherent radiation, wherein the coherent radiation is generated in a magnetic undulator, and/or wherein the coherent radiation is generated in a dipole magnetic field.

Additional embodiments further include accelerating the periodically modulated distribution of coherent electronic current. The periodically modulated distribution of coherent electronic current can be accelerated without using a superconducting material.

In particular embodiments, the target can be a crystal lattice, and the transverse spatial modulation can be imparted via phase contrast. The crystal lattice can have an atomic spacing less than 1 nm. In additional embodiment, the crystal lattice comprises silicon or carbon.

In additional embodiments, the target is a grating, and the transverse spatial modulation is imparted via diffraction contrast. The grating can have a spacing no greater than about 1,000 nm, and/or the grating can comprise silicon.

In particular embodiments, the electron bunch can be focused and/or magnified before transferring the transverse spatial modulation of the electron bunch to the longitudinal axis. Additionally, solenoid magnets and quadrupole magnets can be used to focus and/or magnify the electron bunch. In particular embodiments, the electron bunch is generated by directing photons from a laser onto a cathode.

An apparatus for generating coherent electronic current comprises an electron source configured to emit an electron bunch along a longitudinal axis; at least one magnet structure selected from a solenoid and quadrupole magnets positioned to receive and focus and/or magnify the electron bunch; a target positioned to receive the electron bunch from the magnet structure, wherein the target imparts a transverse spatial modulation to the electron bunch via at least one of diffraction contrast and phase contrast; and an emittance exchange beamline positioned and configured to convert a transverse structure of the electron bunch to a longitudinal structure along the longitudinal axis to produce a periodically modulated distribution of coherent electronic current.

Particular embodiments further include an enhancement cavity including optical elements that define an optical path in the enhancement cavity, wherein the enhancement cavity is positioned to receive the periodically modulated distribution of coherent electronic current; and a laser positioned and configured to generate photons and to direct the photons into the enhancement cavity for circulation along the optical path in the enhancement cavity where the photons can interact with the periodically modulated distribution of coherent electronic current to generate radiation. The apparatus can also include an accelerator positioned and configured to receive and accelerate the electron bunch, after the transverse spatial modulation, along the longitudinal axis.

Embodiments of the apparatus and methods described herein can offer a variety of advantageous results, including (1) generation of a low-emittance electron bunch and acceleration of the bunch to relativistic energies; (2) generation of a transverse modulation in the electron bunch with 1-1000 nm or sub-nm spacing via diffraction or phase contrast electron diffraction; (3) acceleration of the modulated bunch, then focusing, to optimize the spacing of the projection of the modulation in the transverse direction; (4) exchanging the transverse and longitudinal phase space distributions via an emittance exchange beamline, creating a periodically modulated current distribution; and (5) generation of coherent x-rays by matching the inverse Compton laser scattering resonance condition to the modulation period. Coherent x-rays may also be produced by using a magnetic undulator and matching the undulator resonance condition rather than inverse Compton scattering, which requires a higher energy electron beam, or by using terahertz radiation for inverse Compton scattering.

Figure 1:
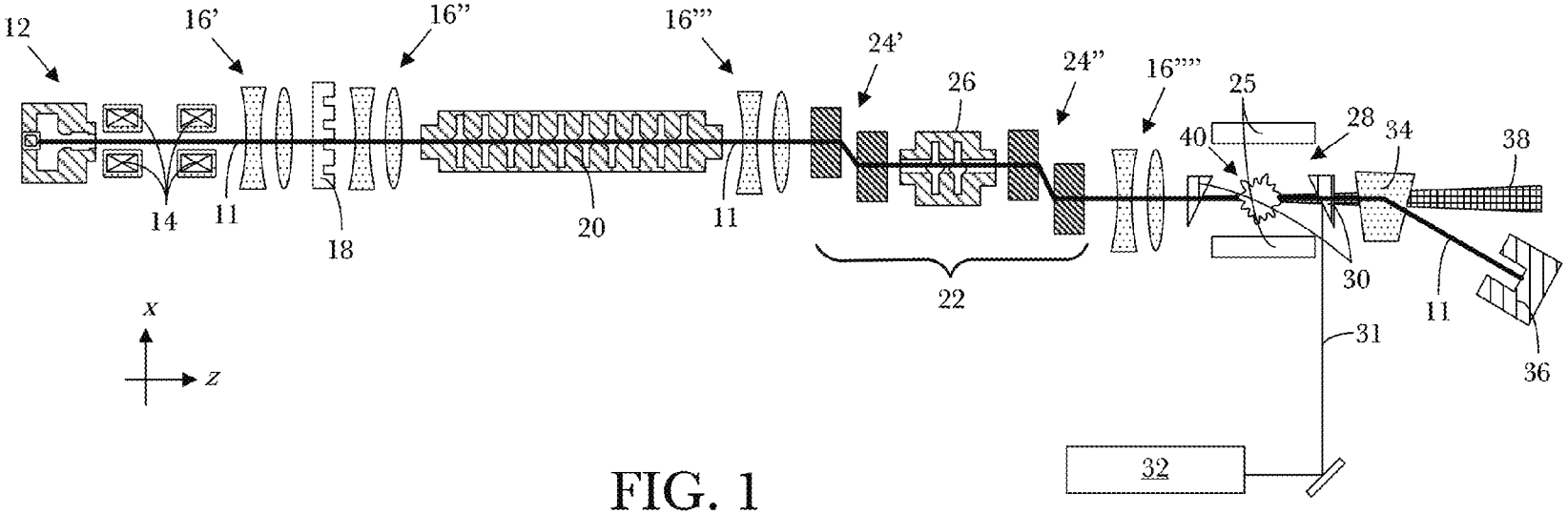
FIG. 1 is a schematic illustration of an embodiment of a compact coherent x-ray source.

In the accompanying drawings, like reference characters refer to the same or similar parts throughout the different views; and apostrophes are used to differentiate multiple instances of the same or similar items sharing the same reference numeral. The drawings are not necessarily to scale; instead, emphasis is placed upon illustrating particular principles in the exemplifications discussed below.

DETAILED DESCRIPTION

The foregoing and other features and advantages of various aspects of the invention(s) will be apparent from the following, more-particular description of various concepts and specific embodiments within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise herein defined, used or characterized, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially, though not perfectly pure, as practical and imperfect realities may apply; e.g., the potential presence of at least trace impurities (e.g., at less than 1 or 2%) can be understood as being within the scope of the description; likewise, if a particular shape is referenced, the shape is intended to include imperfect variations from ideal shapes, e.g., due to manufacturing tolerances. Percentages or concentrations expressed herein can represent either by weight or by volume. Processes, procedures and phenomena described below can occur at ambient pressure (e.g., about 50-120 kPa—for example, about 90-110 kPa) and temperature (e.g., −20 to 50° C.—for example, about 10-35° C.) unless otherwise specified.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments.

Spatially relative terms, such as "above," "below," "left," "right," "in front," "behind," and the like, may be used herein for ease of description to describe the relationship of one element to another element, as illustrated in the figures. It will be understood that the spatially relative terms, as well as the illustrated configurations, are intended to encompass different orientations of the apparatus in use or operation in addition to the orientations described herein and depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to," "coupled to," "in contact with," etc., another element, it may be directly on, connected to, coupled to, or in contact with the other element or intervening elements may be present unless otherwise specified.

The terminology used herein is for the purpose of describing particular embodiments and is not intended to be limiting of exemplary embodiments. As used herein, singular forms, such as "a" and "an," are intended to include the plural forms as well, unless the context indicates otherwise. Additionally, the terms, "includes," "including," "comprises" and "comprising," specify the presence of the stated elements or steps but do not preclude the presence or addition of one or more other elements or steps.

Additionally, the various components identified herein can be provided in an assembled and finished form; or some or all of the components can be packaged together and marketed as a kit with instructions (e.g., in written, video or audio form) for assembly and/or modification by a customer to produce a finished product.

Described herein is an electron beam and x-ray source, wherein the electron beam has a coherent modulation imparted via scattering/diffraction from a target (crystalline, poly-crystalline or amorphous). The modulation of the electron bunch is at the length scale of 0.01-10 angstroms to 1-999 nanometers to 1-999 microns. The modulated electron beam can generate ultra-bright coherent x-rays via inverse Compton scattering or undulator radiation. The electron beam can also be directly used for ultrafast electron diffraction studies.

X-ray beams produced by this source can have the same broad suite of applications as large synchrotron or free-electron laser facilities, which include lithography, protein crystallography, ultrafast chemistry, and x-ray imaging. Additionally, due to its small size and high performance, the compact coherent x-ray source (CCXS), described herein, can be used for applications in hospitals, industrial labs, and universities. In particular embodiments, the compact coherent x-ray source can be configured as a powerful source of hard x-rays for use in electronic chip manufacturing and metrology. The powerful x-ray beam can be monochromatic and tunable in wavelength, and the x-ray beam can contain substantial transverse coherence.

These properties enable phase contrast imaging, a powerful medical technique enabling soft-tissue x-ray imaging with high resolution and low dose. One of the significant advantages that can be provided from this source is that it may reduce the dose received by patients from medical x-rays by several orders of magnitude while generating images of soft tissue that are not believed to be currently possible via other known techniques.

In addition to the x-ray applications, the modulated electron bunches may be used directly for electron diffraction to study the structure of materials. In particular, ultrashort pulses of electrons with duration at the single femtosecond level may be attainable. The periodic transverse and longitudinal electron density modulations may also open new studies of coherent imaging and studies of coherent excitations in materials.

The compact coherent x-ray source produces x-rays via the interaction between an electron bunch and a laser pulse, wherein that interaction is known as inverse Compton scattering (ICS). Inverse Compton scattering can produce a significant x-ray flux with a large number of energetic electrons and an appropriately tuned laser. The compact-coherent-x-ray-source concept augments this inverse-Compton-scattering x-ray flux by generating a longitudinal (in the direction of propagation) modulation to the electron bunch equal to the desired radiation wavelength. The modulated electrons produce a coherent x-ray flux; and free-electron-laser (FEL) gain greatly increases the number of emitted photons and reduce their phase space volume.

As shown in FIG. 1, an electron bunch 11 is generated, e.g., by directing light from a laser onto a cathode (e.g., in a radiofrequency photoinjector 12, which also accelerates the electron bunch 11), as described, e.g., in U.S. Pat. No. 7,391,850 B2. For example, a 35 fs laser pulse would produce approximately 1 pC of charge from a copper cathode in the photoinjector 12. Just after emission, the mean kinetic energy of electrons is 1 eV with a root-mean-square (rms) width of 0.3 eV. The emitted electrons 11 are accelerated in the injector to a relativistic exit energy of several MeV (e.g., 0.5-10 MeV).

The electron bunch 11 is focused by solenoid magnets 14 and then by a first set of quadrupole magnets (quads) 16' onto a target 18. In addition to focusing the electron bunch 11, the solenoids 14 can rotate the bunch 11 as a rigid body about its axis. The solenoid field can be sourced from multiple solenoids 14, as shown, with opposite polarity. This arrangement allows independent control of the focusing strength, which does not depend on field direction, and electron-bunch rotation. For example, at equal and opposite strength, no net rotation occurs although focusing is produced. The degree of rotation and focusing are determined by the ratio of the fields and the integrated field strengths, respectively.

The electron bunch 11 interacts with the target 18, and the target 18 imparts a transverse spatial modulation to the electron beam 11 via diffraction contrast or phase contrast. This modulation can be on the order of 1 Å up to 1-999 microns depending on the arrangement of the diffraction target 18.

In order to spatially resolve this modulation, the electron beam 11 is re-imaged by a second series of quadrupole magnets 16". As the electron beam 11 is imaged, the bunch can be magnified or de-magnified to adjust the spacing of the modulation to match the desired wavelength. The electron bunch 11 can also be accelerated in a linear accelerator 20, which can be powered by a radiofrequency amplifier and which need not utilize a superconducting material, to higher energies to produce a desired x-ray wavelength.

Next, the electron bunch 11 is transported through a third set of quadrupole magnets 16''' and through an emittance exchange (EEX) beamline 22, swapping the longitudinal and transverse phase space distributions, resulting in an electron beam 11 with periodic current modulation. The EEX beamline 22 includes two dogleg bending lines, each including a pair of dipole magnets 24'/24" and separated by a deflecting radiofrequency (RF) cavity 26, which is powered by a radiofrequency amplifier. The dipole magnets 24'/24" in each dogleg are of opposite polarity and separated by a drift space. The deflecting radiofrequency cavity 26 can be driven in the dipole $TM_{11}$ mode so that on-axis electrons are not accelerated and off-axis electrons are deflected in opposite directions by the cavity B-field. The EEX beamline 22 converts the transverse structure (along the x axis) of the beam 11 into the longitudinal direction (along the z axis) and vice versa.

The resulting periodic modulation of current, after passing through a fourth set of quadrupole magnets 16'''', is matched to the resonant wavelength of the inverse-Compton-scattering mechanism in a passive cavity 28 (defined by mirrors 30 and under vacuum) into which infrared light 31 is fed by a laser 32, resulting in coherent addition of the electric fields and greatly enhanced flux and brilliance of a resulting x-ray beam 38 over the ordinary case of incoherent x-ray generation. The infrared light path is defined by the low-loss mirrors 30. The electrons 11 can either be directed around the mirrors 30 or through small orifices (e.g., laser-drilled holes) in the mirrors 30 as they enter and exit the cavity 28.

After exiting the cavity 28, the electrons 11 are diverted by a dipole magnet 34 into a dump 36 for collection while the ICS-generated coherent x-ray radiation 38 passes through.

Electron and Lattice Parameters:

The present analysis is conducted under the assumption that the scattering occurs on a perfect silicon (Si) crystal serving as the target 18 at an electron gun exit energy, E=2 MeV, corresponding to an electron wavelength, $\lambda$=0.00504 Å. The scattering angle of the lowest order (n=1) diffracted beam from Bragg's law, $n\lambda=2d \sin \theta_B$, is $2\theta_B$=0.929 mrad with respect to the incident electron beam 11 for a Si lattice spacing of d=5.43 Å. This small diffraction angle proves advantageous as it should limit aberrations in the downstream electron optics; and the resolution of the phase-contrast image improves with the number of diffracted beams (higher order/larger angle) that are used to image the sample.

An estimate of the sample thickness, t, for developing a significant phase contrast is given by normalized amplitude, $|\phi_g|^2$, of the lowest order diffracted beam, $$|\varphi_g|^2 = \sin^2\left(\frac{\pi t}{\xi_g}\right),$$

where $\xi_g$=441 nm is the extinction length given by $$\xi_g = \frac{\pi V_c \cos\theta_B}{\lambda F_g}$$

with a structure factor of $F_g$=22.6 Å, $V_c$=(0.543 nm)$^3$.

Electron Modulation Via Electron Diffraction:

One approach for producing modulation in the electron bunch 11 is to vary the thickness of the Si crystal 18 as a function of position along the x axis. Varying the thickness (measured along the z axis) of the target 18 as a function of displacement along the transverse (x) axis results in a modulation of the scattered intensity, known as diffraction contrast. The limitation on the modulation in this embodiment is how small of a period one could manufacture into the crystal grating 18, which with current technology is tens of (e.g., 10-99) nanometers.

The matching conditions for the electron beam 11 at the target 18 are determined by the number of micro-bunches that are desired. Considering production of 5 angstrom radiation, an electron beam 11 with a focus size of 5 μm on the crystal 18 produces N=10,000 bunches. With 1:1 imaging and emittance exchange, this corresponds to 17 fs, which easily overlaps with the infrared (IR) pulse 31 at the inverse Compton scattering interaction point 40. A larger N is only limited by the desired charge per micro-bunch and the temporal overlap with the inverse-Compton-scattering laser light 31. The transverse dimension, y, that does not undergo emittance exchange is less critical; and its cross section on the target can be larger to decrease the effects of space charge.

Figure 2:
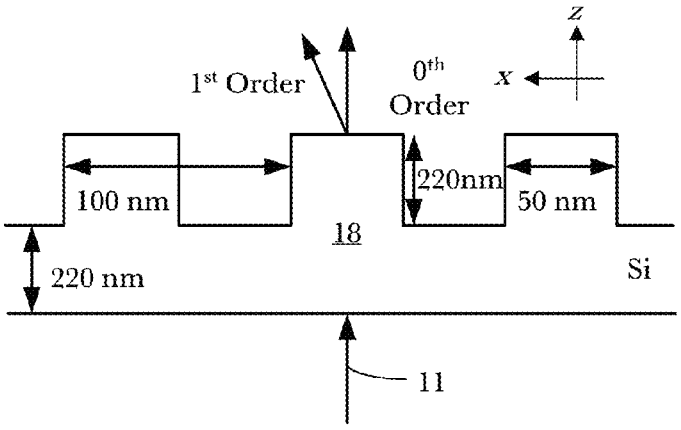
FIG. 2 is a sectional illustration of a grating geometry for diffraction contrast.

FIG. 2 shows an exemplary geometry of a Si grating serving as a diffraction target 18 and the accompanying phase space. The modulation period generated in this setup is 100 nm with a 50% duty cycle. The efficacy of the diffraction setup in generating a modulated electron bunch 11 is determined by the bunching factor, which is defined as $$b_0 = \frac{1}{N_e}\sum_{p=1}^{N_e} e^{ikz_p},$$

where $N_e$ is the number of electrons, $z_p$ is the location of the $p^{th}$ particle, $k=2\pi/\lambda_x$, and $\lambda_x$ is the period of modulation. The forward scattered beam contains 0.56 pC and has a bunching factor, $|b_0|$=0.43, the diffracted beam has 0.44 pC and a bunching factor $|b_0|$=0.54. Either beam can be sent through the emittance exchange 22. If both beams are sent through the emittance exchange 22 and imaged without aberrations, the modulation would disappear. Therefore, one of the two beams will be blocked; and the remaining beam would be sent through the emittance exchange optics 22. The electron beam parameters are listed at various locations in Table 1.

TABLE 1

Electron bunch parameters at different locations:

| Location | Mean kinetic energy (eV) | β | βγ | Beam size (μm) | Opening angle (μrad) |
|---|---|---|---|---|---|
| Cathode | 1 | $2 \times 10^{-3}$ | $2 \times 10^{-3}$ | 30 | $3 \times 10^5$ |
| Injector exit | $2 \times 10^6$ | 0.979 | 4.81 | 200 | 40 |
| Diffraction target | $2 \times 10^6$ | 0.979 | 4.81 | 100 | 20 |
| LINAC exit | $25 \times 10^6$ | 1.000 | 49.9 | 40 | 5 |

In order to generate x-rays with wavelengths less than 1 nm, the pattern generated by diffraction contrast is subjected to significant demagnification, which may prove challenging for the electron optics. Therefore, we propose the use of phase-contrast imaging, which provides modulation on the order of the atomic structure spacing (~5 Å). In this arrangement, we rely on the crystal structure of the target 18 to encode the electron beam 11 with phase that, when properly imaged, allows the crystal structure to be imaged as a modulation of the electron intensity (see Peng, Lian-Mao, Sergei L. Dudarev, and Michael J. Whelan, "High Energy Electron Diffraction and Microscopy," No. 61, Oxford University Press, 2004). Phase-contrast imaging relies on the interference of both the forward scattered and diffracted beam, which is an added advantage because no electrons are lost by blocking a diffracted beam, as required in diffraction contrast.

Figure 3:
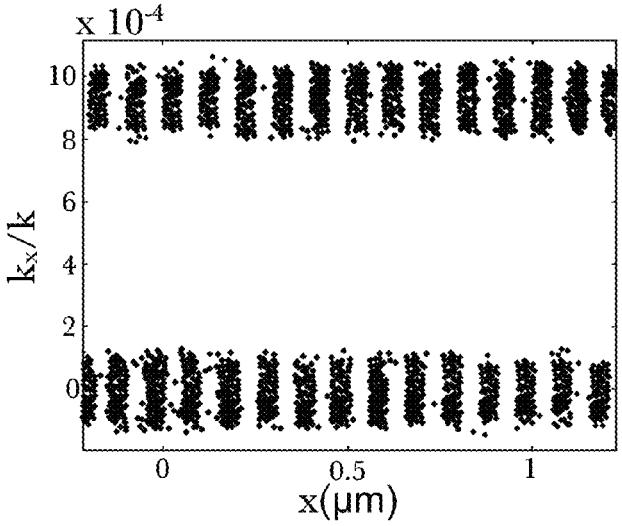
FIG. 3 is a plot of a small section of the phase space for forward scattered and diffracted beams in a method for generating coherent x-rays from a compact source utilizing the grating of FIG. 2.

The feasibility of this phase-contrast-imaging technique relies on the electron beam quality produced by the photoinjector 12—in particular, the momentum spread at the target 18. Simulating the electron bunch 11 from the photoinjector 12, we achieve a maximum momentum spread of 0.21 mrad at the target 18. The silicon diffraction target 18 has a uniform sample depth of 110 nm or $\xi_g/4$, which results in the optimal mix (50/50) of the forward scattered and diffracted beam for no momentum spread. The results of electron diffraction simulations including momentum are shown in FIG. 3, with excellent phase contrast demonstrating the feasibility of this approach.

Radiofrequency (RF) Acceleration:

To generate x-rays, the electron energy is set to meet the resonance condition (see W. J. Brown and F. V. Hartemann, "Three-dimensional time and frequency-domain theory of femtosecond x-ray pulse generation through Thomson scattering", Phys Rev ST-AB 7, 060703, 2004) for the desired x-ray wavelength. The electron energy generally ranges from 2-25 MeV to generate 10-0.1 nm radiation by scattering with a 1 um wavelength laser. The electron bunch 11 is accelerated in the photoinjector 12 to reach an energy of, e.g., 2 MeV at the injector exit. The electrons 11 are diffracted, and the energy may be raised as desired by a short RF linear acceleration (LINAC) 20. Depending on the arrangement of the electron optics (e.g., magnetic lenses) some magnification or demagnification of the modulation electron bunch 11 will occur. This magnification or demagnification can be used as an advantage to tune the wavelength of the coherent x-rays 38 that are generated. At this point, the modulation has been prepared for entering the emittance exchange line 22 described below. The x-projection of the periodic structure of the electron bunch 11 with sub-nm spacing will be exchanged into the longitudinal z-direction to produce coherent radiation. The accelerating structures can be copper RF cavities, superconducting RF cavities at low temperature, or static fields in a direct current (DC) injector followed by RF acceleration.

Terrahertz (THz) Acceleration as an Alternative:

The RF gun 12 and linear accelerator 20 may be replaced in whole or in part by a terahertz (THz) acceleration structure. THz structures show promise to decrease the size, cost, and power requirements of accelerators due to their ability to support much higher gradients (thus shorter structures) in a small volume (decreasing the power required) enabled by the higher frequency compared to RF structures. In principle, GeV/m accelerating gradients can be achieved if the operational frequency is high enough. With recent advances in the generation of THz pulses (i.e., between the microwave and infrared regions of the electromagnetic spectrum) via optical rectification of a laser pulse, in particular improvements in efficiency and multi-cycle pulses, increasing accelerating gradients by two orders of magnitude over conventional RF structures has become a possibility.

Emittance Exchange Beamline:

The purpose of the emittance exchange line 22 is to exchange the transverse modulation produced by diffraction into the longitudinal (time-momentum) plane where it is used to produce coherent radiation. In contrast to most electron beam optics that strive to prevent coupling of the three-phase space planes, an emittance exchange line 22 is designed to completely swap the properties of two of the planes. Electron beam transport can be described as a set of linear equations represented by the following matrix equation:

$$\sigma_1 = R\sigma_0\tilde{R},$$

where the σ matrix elements consist of the electron beam's second moments, the R matrix is a linear transport matrix representing, e.g., drift space, bending, focusing, and acceleration, and $\tilde{R}$ is its transpose. The R matrix must satisfy several constraints (as described in D. A. Edwards and M. J. Syphers, An Introduction to the Physics of High Energy Accelerators, New York, Wiley-Interscience, 1993) to be physically realizable. In general, the σ and R matrices are 6×6 arrays representing the beam's 6D phase space.

For our purposes, we will ignore the y-dimension and consider 4D matrices representing the x and z directions that are to be exchanged. The R matrix then has the following form:

$$R = \begin{pmatrix} A & B \\ C & D \end{pmatrix}.$$

where A, B, C, and D are 2×2 sub-matrices. For typical beam transport and acceleration elements, there is no coupling between transverse and longitudinal planes so that B=C=0, while the elements of A and D are nonzero. However, the emittance exchange beamline 22 is designed for complete exchange of x and z phase space dimensions; and so the elements of B and Care nonzero, while A=D=0 (see M. Cornacchia, P. Emma, Phys Rev ST-AB 5, 084001, 2002). A beamline 22 that achieves this condition (see K. J. Kim, A. Sessler, Proc. Inter. Workshop Beam Cooling—COOL05, 115-138, Galena, Ill., 2005) is shown in FIG. 1. The beamline 22 includes two identical dogleg transport lines 24' and 24" separated by an RF cavity 26. The dogleg lines 24 include equal bends in opposite directions separated by a drift space. The RF cavity 26 is driven in the dipole $TM_{11}$ mode so that on-axis electrons are not accelerated and off-axis electrons are deflected in opposite directions by the cavity B-field.

The emittance exchange R matrix performs a complete exchange of phase space properties between two orthogonal planes, in our case the x and z directions. This means that the periodicity along the transverse (x) axis of our modulated electron bunch is transferred to the longitudinal dimension, while the smooth z-distribution of electron current is transferred to the transverse x-dimension; and, similarly, the upstream transverse momentum spread, manifest as the beam's opening angle entering the emittance exchange line 22, becomes the longitudinal energy spread, and vice versa.

The B and C matrices completely exchange transverse and longitudinal coordinates, but the non-zero off-diagonal terms of each 2×2 sub-matrix result in strong correlations in the output beam between x and $p_x$ (transversely) and z and $p_z$ (longitudinally) that are cancelled by appropriate correlations in the input distribution.

Coherent X-Ray Radiation:

TABLE 2

Estimated performance at 12 keV photon energy assuming 10% coherent bunching:

| Parameter | Coherent ICS | Incoherent ICS | Units |
|---|---|---|---|
| Photons per pulse | $6 \times 10^7$ | $4 \times 10^6$ | 1% bandwidth |
| Average flux (0.1% BW) | $6 \times 10^{11}$ | $4 \times 10^{10}$ | photons/ (sec 0.1%) |
| Bandwidth | 1 | 1 | % |
| Average brilliance | $3 \times 10^{17}$ | $2 \times 10^{13}$ | photons/ (s 0.1% $mm^2mrad^2$) |
| Peak brilliance | $8 \times 10^{26}$ | $2 \times 10^{20}$ | photons/ (s 0.1% $mm^2mrad^2$) |
| Coherent fraction | 0.1 | .0001 | % |
| Opening angle | 0.2 | 3 | mrad |
| Source size | 1 | 3 | μm |
| Pulse length | 3 | 1000 | fs |
| Charge per pulse | 1 | 50 | pC |
| Repetition rate | 100 | 100 | kHz |
| Average current | 0.1 | 5 | μA |

Table 2, above, summarizes the estimated coherent inverse Compton scattering properties, assuming a bunching factor of 0.1 and compares those properties to a high-performance incoherent inverse-Compton-scattering source. The estimated coherent photon flux is limited by extracting 0.5% of the stored electron beam energy, which at 25 MeV, corresponds to about 10 emitted photons per electron. For a bunch with 1 pC charge, this amounts to $6\times10^7$ photons per pulse, which is an order of magnitude higher than incoherent inverse Compton scattering even though the bunch charge is a factor of 50 lower. The coherent process is not only more efficient, but also produces much larger x-ray brilliance due to its high coherence. The beam 11 has significant transverse coherence, but may or may not develop a dominant single (transform-limited) mode depending on the precise beam dynamics. At sufficiently small emittance and large wavelength, free-electron laser (FEL) gain occurs and produces a transform-limited mode. At shorter wavelengths and/or larger emittances, the initial coherent bunching still occurs; but the gain process is not supported, and many transverse modes may be excited.

Advantages and Improvements over Existing Methods:

Existing methods of x-ray generation include (1) conventional fixed metal anode x-ray tubes and modifications with rotating or liquid metal anodes, (2) inverse Compton scattering in either a small linear accelerator or a small storage ring, and (3) large scientific facilities, such as synchrotrons and x-ray free electron lasers. Method (1) has low brightness, is not monochromatic, except at fixed wavelengths, and is not coherent. While Bremsstrahlung is the source of medical x-rays and is widely used for scientific work, it is many orders of magnitude less intense than the other sources. Method (2) has demonstrated good performance but does not rely on coherent x-ray generation via a modulated beam so it is orders of magnitude less efficient than the proposed method. Method (3) facilities have the highest demonstrated x-ray performance but often cost $100 million to $1 billion and have lengths greater than a kilometer. The estimated cost of the source described herein can be less than $5 million, and its dimensions can be less than 5 meters.

The proposed method relies on coherent emission of x-rays due to a periodic modulation of the electron beam current at the x-ray wavelength. The effect of coherence is both to make the x-ray beam more powerful (i.e., higher x-ray flux per electron) and to cause the x-rays to occupy a smaller phase space volume (i.e., a brighter beam). Both of these attributes are important scientifically. Higher flux enables experiments on smaller samples, higher sensitivity to phenomena with a low cross-section, better spatial and temporal resolution, and faster data acquisition times. A brighter beam enables imaging methods based on phase interference, such as coherent Bragg diffraction or various phase-contrast imaging methods.

In a previous method from some of the present inventors, a modulation of the electron bunch was generated using a nano-emitter array in the photo injector (see U.S. Pat. No. 8,787,529 B2 and W. S. Graves, P. Piot, F. X. Kärtner, and D. E. Moncton, "Intense Superradiant X Rays from a Compact Source Using a Nanocathode Array and Emittance Exchange," Phys Rev Lett 108, 263904, 2012). The electron diffraction method described here has two clear advantages over this earlier method:

1. the modulation is imparted on the electron bunch at a relativistic energy, greatly reducing space charge effects; and
2. electron diffraction is capable of directly producing sub-nm scale modulation, which allows for the production of coherent hard x-rays, increasing the scientific and commercial interest in this device; this modulation could not be produced directly with nano-patterned emitter cathodes, which are currently limited to tens of nm or larger scale.

An alternative method of producing a coherent modulation is the x-ray free-electron laser, whereby emitted x-rays act on the electron beam to cause a similar periodic modulation. This approach has been demonstrated at large facilities, such as SLAC National Accelerator Laboratory, which utilizes 1 km of linear accelerator to accelerate the electrons to GeV energies. The method described herein reduces the electron energy and, thus, the size and cost of the device by several orders of magnitude. The physics of an FEL-like interaction for a beam undergoing inverse Compton scattering has been described in P. Sprangle, B. Hafizi, and J. R. Penano, Phys. Rev. ST-AB 12, 050702 (2009), but the electron beam requirements for that concept are well beyond state-of-the-art and are believed to be unlikely to be realized. The requirements for the compact coherent x-ray source electron beam are significantly eased from those because it arrives at the interaction region already pre-bunched and can reach full power output with much lower power laser and electron beams.

Exemplary Applications:

Coherent x-rays generated via the above approach are useful for medical imaging, where coherent x-rays may have three impacts in terms of enabling phase-contrast techniques, including (1) reducing the patient dose by orders of magnitude compared to traditional radiography, (2) enabling sensitive imaging of soft tissue, and (3) improving the spatial resolution over conventional radiography.

Additional large markets for industrial, scientific, and military x-rays produced via this approach include extreme ultraviolet (EUV) lithography, x-ray microscopy, protein crystallography, and studies of ultrafast phenomena. The proposed method enables the proliferation of high performance x-rays similar to those produced by large synchrotron facilities and free-electron lasers into labs where they are not currently available.

Supplementary Discussion

Compact X-ray Light Source (CXLS) Project Introduction:

The CXLS project is focused on producing coherent x-ray beams by transferring a spatial electron modulation from a nanocathode array into a temporal modulation using emittance exchange. The nanocathode arrays have an emitter pitch of 100 nm to 10 microns and are well suited to coherent x-ray production at 1 nm and longer wavelength. An alternative approach that shows promise for coherent hard x-ray production is to produce the spatial modulation via electron diffraction at relativistic energy. Transmission electron microscope (TEM) phase-contrast images demonstrate <10 Angstrom level modulation, which may be required for hard x-ray production. This modulation pattern can undergo emittance-exchange (EEX) bringing the transverse modulation into longitudinal plane and producing coherent x-rays via inverse Compton scattering (ICS). Beyond CXLS, generating multiple electron bunches from a single electron bunch that share timing, emittance and beam dynamics characteristics opens up a host of new experiments including seeded FELs and pump probe experiments with electron excitation and detection.

There are two applications relevant to CXLS that could be of interest. The first is extending the achievable range of micro-bunching in the electron beam below the nm level and into the hard X-ray regime. The second is generating micro-bunching for alternate electron gun configurations where spatial/space charge constraints are increased, for example a THz gun or DC gun.

General Setup Description:

We propose modifying the existing CXLS LINAC design to include an electron diffraction chamber upstream of the X-band LINAC and downstream of the RF Gun. Properly matching the electron beam 11 to the target 18 and the EEX setup 22 is achieved via the addition of a few magnets 16 for electron optics. FIG. 1 illustrates the CXLS LINAC with the location of the target 18 included.

We begin with some useful definitions that will be further referenced, below:

$$\gamma = 1 + \frac{E[\text{keV}]}{511}; \tag{1}$$

$$\beta = \frac{v}{c} = \frac{\sqrt{\gamma^2 - 1}}{\gamma^2}; \tag{2}$$

$$p = \beta\gamma mc; \tag{3}$$

$$\lambda = p/h; \text{ and} \tag{4}$$

$$k = \frac{2\pi p}{h}, \tag{5}$$

where v is the electron velocity, m is the electron mass. and E is the electron energy.

Emittance Estimate:

In order to properly predict the behavior for diffracted electrons from this setup, we need to determine the angular spread of the electrons arriving at the crystal. We begin by considering the normalized emittance for the electron bunch, which has a parabolic charge distribution in the transverse dimension and can be asymmetric in the transverse dimension. The normalized emittance is expressed as follows:

$$\varepsilon_{xn} = \frac{1}{mc}\sqrt{\langle x^2\rangle\langle p_x^2\rangle - \langle xp_x\rangle^2}. \tag{6}$$

We will consider uncorrelated electron bunches, which results in $\langle xp_x\rangle^2=0$, and the above expression is simplified to the following:

$$\varepsilon_{xn} = \frac{1}{mc}\sqrt{\langle x^2\rangle\langle p_x^2\rangle}. \tag{7}$$

For a parabolic profile, $$\langle x^2\rangle = \frac{x_{max}^2}{5},$$

and for a flat-top angular spread, $$\langle p_x^2\rangle = \frac{p_{x_{max}}^2}{3};$$

and we can state the following:

$$p_{x_{max}} = \frac{\sqrt{15}\,\varepsilon_{xn}mc}{x_{max}}. \tag{8}$$

The expression given in Equation (8) will be useful in predicting the emittance required to produce the desired modulation.

Electron and Lattice Parameters:

The present analysis is conducted under the assumption that the scattering occurs with E=2 MeV on a single grain Si crystal. This corresponds to an electron wavelength, $\lambda$=0.00504 Å. With a lattice spacing of a=5.43 Å for Si, we can see from Bragg's law, $\lambda=2a_{hkl}\sin\theta_B$, that for the lowest order diffracted beam, (hkl=111) $2\theta_B$=1.61 mrad with respect to the incident electron beam. This small diffraction angle proves advantageous as it should limit aberrations in the downstream electron optics and the resolution of the phase-contrast image improves with the number of diffracted beams (higher order/larger angle) that are used to image the sample.

An estimate of the target thickness, t, required to develop a significant phase contrast is given by normalized amplitude, $|\phi_g|^2$, of the lowest order diffracted beam $$|\varphi_g|^2 = \sin^2\left(\frac{\pi t}{\xi_g}\right),$$

where $\xi_g$=441 nm is the extinction length given by $$\xi_g = \frac{\pi V_c\cos\theta_B}{\lambda F_g}$$

with a structure factor of $F_g$=22.6 Å, $V_c=(0.543\text{ nm})^3$.

In order to analyze the scattering process, we switch to momentum space, where $k_0$ is the momentum vector for the incident electron; k' is the diffracted electron; and g=2πd is the momentum imparted by the lattice. In k-space, we write Bragg's law as ng=2 k sin $\theta_B$. The scattering geometry is shown in greater detail in FIG. 6. Unfortunately, due to the finite emittance of the electron bunch, it is not possible for all of the k vectors of the incident particles to be properly aligned with the crystal plane such that $\vec{k}_0+\vec{g}=\vec{k}'$. If this condition is not met, we define a deviation vector, $\vec{s}$, such that $\vec{k}_0+\vec{g}=\vec{k}'+\vec{s}$, which will result in a decreased probability of interacting with the crystal lattice for increasing $\vec{s}$.

In order to understand the role of the deviation vector, we analyze its effect on the diffraction pattern. From the kinematical point of view, the diffracted beam intensity is given by a wavefunction with amplitude and phase that are determined by summing over the contributions given by all of the atoms in the illuminated structure, as follows:

$$\psi(\Delta\vec{k}=\vec{k}_0-\vec{k}')=S(\Delta\vec{k})F(\Delta\vec{k}) \tag{9}$$

These contributions are divided into the following two categories: the structure factor, $F(\Delta\vec{k})$, and the shape factor, $S(\Delta\vec{k})$. The structure factor is determined by the unit cell of the crystal lattice, and its contribuation depends only on $\vec{g}$ (physically, over the spatial extent of one unit cell, errors in $\vec{s}$ are negligible compared to those from scattering of many unit cells). In the ideal case, when $\vec{k}_0+\vec{g}=\vec{k}'$, then $S(\Delta\vec{k})$=N, where N is the number of scattering planes. When $\vec{k}_0+\vec{g}=\vec{k}'+\vec{s}$, the shape factor is defined as follows:

$$S(\Delta\vec{k}) = \sum_{r_g}^{lattice} e^{-i2\pi\Delta\vec{k}\cdot r_g} = \sum_{r_g}^{lattice} e^{-i2\pi(\vec{g}-\vec{s})\cdot r_g} = \sum_{r_g}^{lattice} e^{i2\pi\vec{s}\cdot r_g}, \tag{10}$$

noting that $\vec{g}\cdot\vec{r}_g$=integer. For the case in which we are interested, shifts between planes are given by $\vec{r}_g=a_x\hat{x}$ (see FIG. 6) and the diffracted intensity is given by the following:

$$I(\Delta\vec{k}) = |F(\Delta\vec{k})|^2 \frac{\sin(\pi a_x s_x N_x)^2}{\sin(\pi a_x s_x)^2}. \tag{11}$$

Another concern is dispersion induced in the electron beam in the form of a correlation between x' and E due to energy spread in the electron beam. Energy spread will result in momentum spread, $k=k_0+\Delta k$; and applying Bragg's law under the assumption of small diffraction angles, $ng\approx 2\Delta k\Delta\theta_B$, which gives a dispersion as follows:

$$\Delta\theta_B \approx \frac{ng\Delta\lambda}{4\pi}. \tag{12}$$

For diffraction contrast, this dispersion is not a concern because we rely on the modulation being set in place by separating the electron bunch into forward scattered and diffracted beams. The separation of the two beams is $\theta_B$ with an energy spread on the order of $10^{-4}$, which corresponds to a correlation of $|\Delta\theta_B|\leq\theta_B\cdot 10^{-4}$, which is much smaller than the separation between the two beams.

Figure 7:
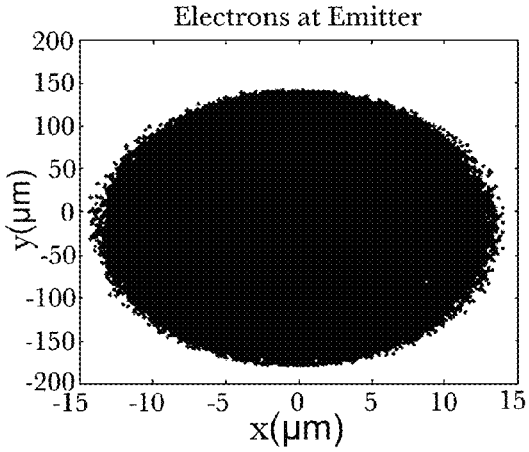
FIG. 7 is a plot of the x-y distribution of electrons at an emitter.
Figure 8:
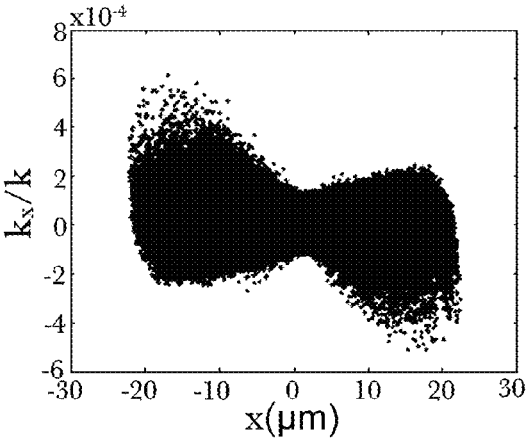
FIG. 8 plots the phase space for the scattering dimension in the crystal.

The examples presented herein use an electron bunch distribution that was generated with a Parmela simulation using the CXLS 2.5 cell RF gun and including space charge. The electron bunch is generated with a parabolic charge distribution with hard edge limits of 15 μm in the x dimension and 150 μm in the y dimension. The electron charge, 1 pC, is generated over 35 fs in order to operate in the blowout regime and minimize emittance growth. The electron beam parameters are listed for various locations in Table 3, below. The x-y distribution of electrons at the emitter is shown in FIG. 7, and the phase space for the scattering dimension at the crystal is shown in FIG. 8.

TABLE 3

Electron beam parameters when collimated:

| | $\epsilon_{xn}$ | $\epsilon_{yn}$ | $\sigma_x$ | $\sigma_y$ | $x'_{rms}$ | $y'_{rms}$ |
|---|---|---|---|---|---|---|
| Emitter | 3 nm-rad | 36 nm-rad | 5.1 μm | 73 μm | 0.32 rad | 0.32 rad |
| Gun Exit | 5.1 nm-rad | 36 nm-rad | 220 μm | 410 μm | 4.7e−6 rad | 6.0e−6 rad |
| Crystal | 5.1 nm-rad | 36 nm-rad | 10 μm | 19 μm | 1.0e−4 rad | 0.013 rad |

Strength of Interaction:

We now consider how strongly the electron beam will scatter from the Si lattice. For an electron with one possible scattering, $\vec{g}$ and $\vec{k}_0+\vec{g}=\vec{k}'$, the extinction length corresponds to the length over which the probability of undergoing two interactions, $(\vec{g}, -\vec{g})$ is 1. We previously calculated the extinction length to be $\xi_g$=441 nm. We can write the intensity of the diffracted and forward scattered beams as follows:

$$I_0=|\phi_0|^2=\cos(\pi z/\xi_g)^2 \text{ and} \tag{13}$$

$$I_g=|\phi_g|^2=\sin(\pi z/\xi_g)^2, \tag{14}$$

where $I_0$ is the intensity of the forward scattered beam, and $I_g$ is the intensity of the diffracted beam at $2\theta_B$. If we include the possibility of deviations, $\vec{k}_0+\vec{g}=\vec{k}'+\vec{s}$, then the intensities become:

$$I_0 = 1 - I_g; \tag{15}$$

$$I_g = \frac{\sin(\pi z/s_{eff})^2}{\xi_g^2 s_{eff}^2}; \text{ and} \tag{16}$$

$$s_{eff} = \sqrt{s^2\xi_g^{-2}}. \tag{17}$$

Figure 9:
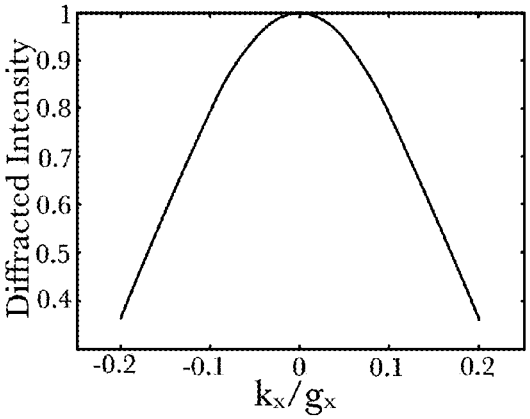
FIG. 9 is a plot of the diffraction intensity of $k_{xmax}/k_0=0.14$ mrad.
Figure 10:
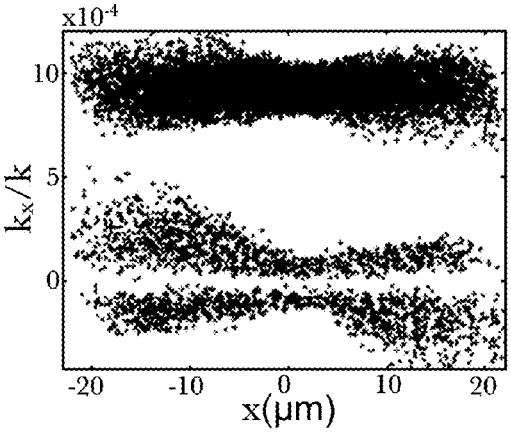
FIG. 10 is a plot of the phase space for forward scattered and diffracted beams, which can be compared with the original phase space is shown in FIG. 8.

From Table 3, we see that we can reasonably expect the emittance to be 5.1 nm-rad at the crystal. Using Equation (8), we can calculate an expected maximum momentum spread of 0.21 mrad based on a maximum width of $x_{max}$=22 μm. In FIG. 9, the diffraction intensity is shown as a function of the momentum spread. FIG. 10 shows 75% of the electrons incident being diffracted by $2\theta_B$~1 mrad with respect to the forward scattered beam.

Diffraction Contrast:

As noted, above, one approach for producing modulation in the electron bunch is to vary the thickness of the Si crystal as a function of x. From Equations (15) and (16), we can see that varying the thickness (in the z direction) spatially (as a function of displacement along the x axis) results in a modulation of the scattered intensity. Subsequently, one of the two beams can be blocked, and the remaining beam is sent through the EEX optics. FIGS. 2 and 3, respectively show the proposed geometry of the Si grating and the accompanying phase space. The forward scattered beam contains 0.56 pC and has a bunching factor $|b_0|$=0.43; the diffracted beam has 0.44 pC and a bunching factor $|b_0|$=0.54. Either beam could be sent through the EEX. If both beams are sent and imaged without aberrations, the modulation would disappear.

Phase Contrast:

In order to generate hard x-rays without significant amounts of demagnification, phase-contrast imaging can provide modulation on the order of the atomic structure spacing (e.g., ~5 Å). Phase-contrast imaging relies on the interference of the forward scattered and diffracted beam. The present analysis is limited to considering this interference at the exit of the Si crystal (in vacuum) and will be described with a wavefunction for the electron that is produced by a superposition of the diffracted beam, $\phi_g$, with the forward scattered beam, $\phi_0$:

$$\phi_0(r)=\phi_0(z)e^{i\vec{k}_0\cdot\vec{r}} \text{ and} \tag{18}$$

$$\varphi_g(r) = \varphi_g(z)e^{i(\vec{k}_0+\vec{g})\cdot\vec{r}}. \tag{19}$$

The amplitude of these two wavefunctions is determined by the excitation of two Bloch waves ($\psi_1$, $\psi_2$) at the entrance of the crystal and the relative phase of these two Bloch waves is determined at the exit of the crystal.

As the electron bunch arrives at the Si target, no modulation is present in the beam, and its wavefunction is a plane wave with a flat phase front. Once the electron penetrates into the crystal, the electron can no longer be described as a plane wave because the Si atoms act as potential wells and apply a spatially varying phase advance. The Bloch waves $(\psi_1,\psi_2)$ are the new eigen states for the electron, and the incident plane wave excites these two waves with equal amplitude for $\vec{s}=0$. Note that $(\psi_1, \psi_2)$ propagate co-linearly, but they have unique wave vectors $(k^{(1)}, k^{(2)})$ or $(\vec{k}+\gamma^{(1)}\hat{z}, \vec{k}+\gamma^{(2)}\hat{z})$. When the electrons exit the crystal, we once again can describe them as being plane waves with modulated phases. However, depending on the relative phase and amplitude of the two Bloch waves, two diffracted plane waves can be excited $(\phi_0, \phi_g)$. The relationship between the Bloch waves and free space waves is given by the following:

$$\begin{bmatrix}\phi_0(z)\\ \phi_g(z)\end{bmatrix}=\begin{bmatrix}C_0^{(1)} & C_0^{(2)}\\ C_g^{(1)} & C_g^{(2)}\end{bmatrix}\begin{bmatrix}e^{i\gamma^{(1)}z} & 0\\ 0 & e^{i\gamma^{(2)}z}\end{bmatrix}\begin{bmatrix}\psi_1\\ \psi_2\end{bmatrix}. \tag{20}$$

Under a two beam approximation, the expected population as follows can be expressed as follows:

$$\frac{d\phi_0}{dz}=\frac{i}{2\xi_g}\phi_g(z) \text{ and} \tag{21}$$

$$\frac{d\phi_g}{dz}=\frac{i}{2\xi_g}\phi_0(z)+is_g\phi_g(z). \tag{22}$$

Assuming a solution of the form, $C_N^{(n)}e^{i\gamma^{(n)}z}$, the previous equations evaluate to the following:

$$\begin{bmatrix}-\gamma^{(n)} & \frac{1}{2\xi_g}\\ \frac{1}{2\xi_g} & s_g-\gamma^{(n)}\end{bmatrix}\begin{bmatrix}C_0^{(n)}\\ C_g^{(n)}\end{bmatrix}=\begin{bmatrix}0\\ 0\end{bmatrix}, \tag{23}$$

where $$\gamma^2-\gamma s_g-\frac{1}{4\xi_g^2}=0$$

with roots, $$\gamma^{(1)}=\frac{s_g}{2}\left(1+\sqrt{1+(s_g\xi_g)^{-2}}\right) \text{ and } \gamma^{(2)}=\frac{s_g}{2}\left(1-\sqrt{1+(s_g\xi_g)^{-2}}\right).$$

Figure 6:
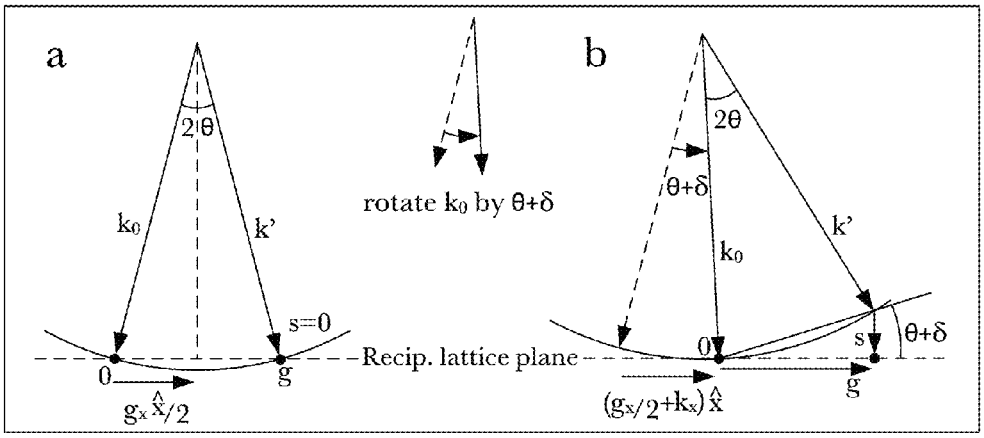
FIG. 6 shows the scattering geometry of an electron beam from (a) ideal incident particle and (b) a particle offset by $k_x$.

Solving for the amplitudes, $C_N^{(n)}$, such that the Bloch wave amplitudes are normalized, produces the following:

$$\begin{bmatrix}\phi_0(z)\\ \phi_g(z)\end{bmatrix}=\begin{bmatrix}\sin(\kappa/2) & \cos(\kappa/2)\\ \cos(\kappa/2) & -\sin(\kappa/2)\end{bmatrix}\begin{bmatrix}e^{i\gamma^{(1)}z} & 0\\ 0 & e^{i\gamma^{(2)}z}\end{bmatrix}\begin{bmatrix}\psi_1\\ \psi_2\end{bmatrix}, \tag{24}$$

where $\kappa=\cot(s_g\xi_g)^{-1}$. At the crystal surface $\phi_0(0)=1$, $\phi_g(0)=0$, $\psi_1=\sin(\kappa/2)$, and $\psi_2=\cos(\kappa/2)$. At the crystal exit, the two waves are expressed as follows:

$$\phi_0(r)=e^{i\vec{k}_0\cdot\vec{r}}e^{is_gz}\left[\cos\left(\frac{s_gz}{2}\sqrt{1+(s_g\xi_g)^{-2}}\right)-i\cos(\cot(s_g\xi_g)^{-1})\sin\left(\frac{s_gz}{2}\sqrt{1+(s_g\xi_g)^{-2}}\right)\right] \text{ and} \tag{25}$$

$$\phi_g(r)=ie^{i(\vec{k}_0+\vec{g})\vec{r}}e^{is_gz}\sin(\cot(s_g\xi_g)^{-1})\sin\left(\frac{s_gz}{2}\sqrt{1+(s_g\xi_g)^{-2}}\right), \tag{26}$$

noting that, in $\hat{x}$, both waves contain modulation in phase on the order of g (see FIG. 6 for clarification). We can describe the total beam image as follows:

$$I_{not}=(\phi_0+\phi_g)(\phi_0+\phi_g), \tag{27}$$

which evaluates to the following:

$$I_{tot}=1+2\sin(\cot(s_g\xi_g)^{-1})\sin\left(\frac{s_gz}{2}\sqrt{1+(s_g\xi_g)^{-2}}\right)\ldots\left[\begin{array}{l}\sin(g_xx)\cos\left(\frac{s_gz}{2}\sqrt{1+(s_g\xi_g)^{-2}}\right)+\\ \cos(g_xx)\cos(\cot(s_g\xi_g)^{-1})\sin\left(\frac{s_gz}{2}\sqrt{1+(s_g\xi_g)^{-2}}\right)\end{array}\right]. \tag{28}$$

Figure 4:
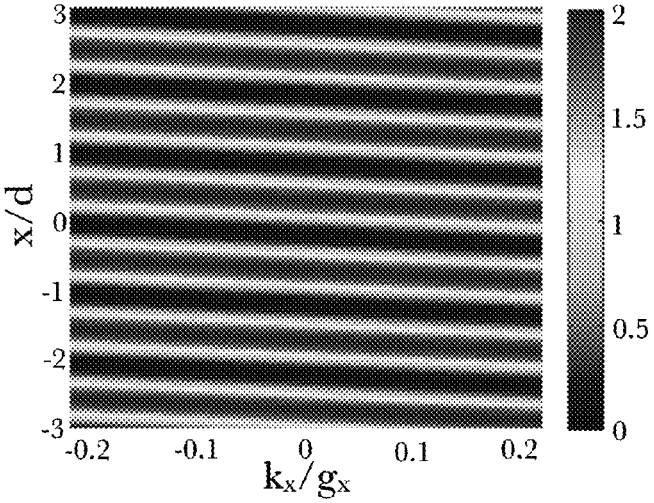
FIG. 4 illustrates the electron population at $z=\xi_g/4$, normalized to the incident intensity, in an electron diffraction simulation.
Figure 5:
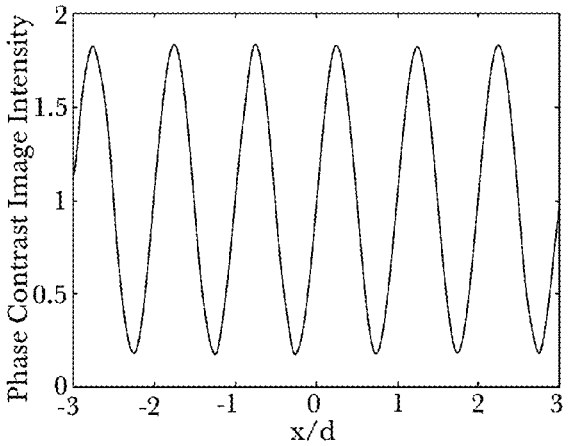
FIG. 5 is a plot of phase-contrast image intensity at crystal exit for $k_{x_{max}}/k_0=0.21$ mrad, normalized to the incident intensity, in the electron diffraction simulation.
Figure 11:
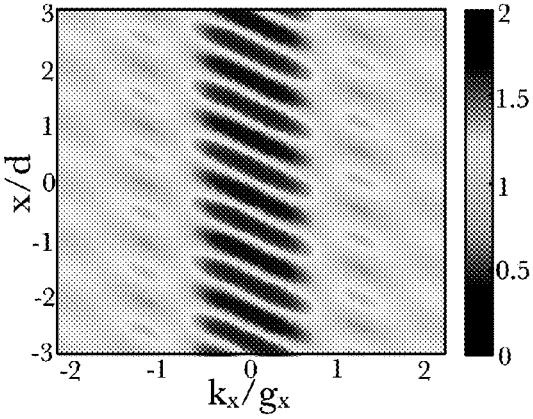
FIG. 11 plots the electron population at crystal exit for $k_{x_{max}}/k_0=2.1$ mrad, normalized to the incident intensity.
Figure 12:
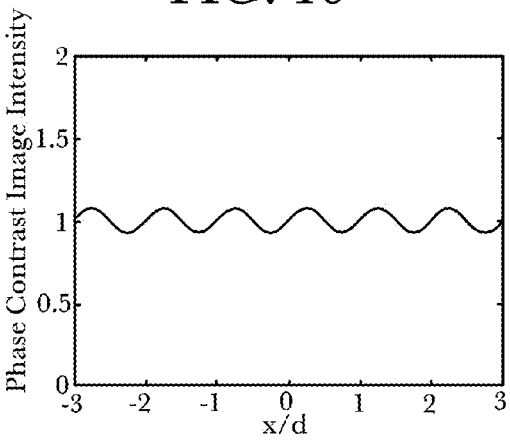
FIG. 12 plots the phase contrast image intensity at crystal exit for $k_{m_{max}}/k_0=2.1$ mrad, normalized to the incident intensity.

We begin by evaluating this expression for the design case with a maximum angular spread of 0.21 mrad and a target depth of 110 nm or $\xi_g/4$, which results in the optimal mix (50/50) of the forward scattered and diffracted beam. The results are shown in FIGS. 4 and 5 with excellent phase contrast. Also interesting to consider is the maximum angular spread of 2.1 mrad, which is one order of magnitude greater than the design case and larger than the Bragg angle with results shown in FIGS. 11 and 12.

Requirements for Imaging:

We showed that the electron beam has a small enough emittance to produce a modulation at the exit of the crystal due to the interference of the forward scattered and diffracted beam. After exiting the crystal, the electron population is defined by the propagation of two plane waves that describe each electron. Next, the electron beam is propagated through optics, and the modulation is re-imaged. Just as interference was checked by propagating the electrons through the crystal, the accumulated phase can be compared between the two diffracted beams at the image plane (IP).

First considered are the magnetic elements that will be used. In a traditional setup, the target is followed by an objective lens that reimages the beam with a magnification, M, of 20-50 times. This objective has the practical effect of decreasing the opening angle, $\alpha_0$ (for zero emittance growth), which allows for significantly reduced constraints on aberrations due to subsequent lenses. The objective aperture of this lens is set by a diaphragm that is used to limit the presence of electrons scattered at large angles (elastically or inelastically) that would not contribute to the image. For an ICS or FEL experiment, it is not clear that these electrons should be rejected as they can contribute to the total x-ray flux if the interaction is a sufficient number of gain lengths. For now, only solenoids with a field profile, $$B_z=\frac{B_0}{1+(z/a)^2},$$

where 2a is the full width at half maximum (FWHM) of the field will be considered for the objective lens. The dimensionless lens parameter for a solenoid is represented as follows:

$$k^2 = \frac{eB_0^2a^2}{8m_0U^*}, \tag{29}$$

where $B_0$ is the magnetic field strength in Tesla, and $$U^* = U\left(1 + \frac{E}{2E_0}\right).$$

Spherical aberrations from the optical elements in the setup are one of the limiting factors for determining an initial estimate for the achievable resolution; in this setup, we consider a linear optics prediction for our imaging setup. For a solenoidal focusing lens, the effect of the spherical aberration on the achievable resolution is expressed as follows:

$$d_{s,min}=0.5C_s\alpha_0^3, \tag{30}$$

where $C_s$ is the spherical abberation coefficient, and $\alpha_0$ is the angular spread of the electron beam. For diffraction contrast, $\alpha_0 \approx 0.1$ mrad; and, for phase contrast, $\alpha_0=1$ mrad. Assuming a phase contrast setup and $C_s=200$ mm, then $d_{s,min}=0.1$ nm. $C_s$ is between f and f/4 for a weak or strong lens, respectively. Additionally, for phase contrast, it is more appropriate to consider the wave-optical formulation of the abberation.

Chromatic aberrations may also be a significant issue for the successful imaging of the phase contrast setup. The limit on image resolution for the chromatic aberration is given as follows:

$$d_c = \frac{\Delta E}{E}C_c\alpha_0, \tag{31}$$

where $C_c$ is the chromatic aberration coefficient, which is between f and f/2 for a weak or strong lens, respectively. For a diffraction contrast case with $\alpha_0=0.1$ mrad, $\Delta E/E=10^{-4}$ ($\Delta E=200$ eV at 2 MeV) and a target of $d_{c,min}=1$ nm, we need $C_c=100$ mm. For a phase contrast case with $\alpha_0=1$ mrad, $\Delta E/E=10^{-4}$, and a target of $d_{c,min}=0.1$ nm, we need $C_c=1$ mm or a focal length of 2 mm.

In the wave-optical formulation, the effect of abberations is given by a phase shift, $W(\theta)=2\pi\Delta s/\lambda$, where $\Delta s$ is the change in optical path with respect to the ideal spherical wave front. The phase shift can result from the following three effects:

1. spherical abberations;
2. thickness of target; and
3. change in focal length due to energy.

These effects combine to give a total phase shift of:

$$W(\theta) = \frac{\pi}{2\lambda}(C_s\theta^4 - 2(\Delta f - \Delta a)\theta^2), \tag{32}$$

where $\Delta f=f\Delta E/E$; and $\Delta a$ is the variation of the longitudinal position of the target (effectively due to tilt) and is kept to on the order of $\Delta f$. It is sufficient to keep $\Delta a$ on the order of 20 μm for diffraction contrast and on the order of 200 nm for phase contrast. For an illumination spot of 100 microns, this is a tilt of 0.2 rad and 2 mrad, both of which are weaker tolerance than the 0.1 mrad alignment for the crystal plane. This axial displacement, $\Delta a$, can also be used to decrease the effect of $\Delta f$ due to energy spread. For a focal length of 2 mm and $\Delta E/E=10^{-4}$, the offset, $\Delta a=200$ nm.

To observe modulation on the electron beam that is on the order of the lattice spacing, a=5.43 Å, we sample the distribution at a/2 (Nyquist sampling); or, in other words, the setup is designed to collect electrons from a momentum space that covers $k_\perp=4\pi/a$ or $k_\perp/k_0=1.85$ mrad, which includes a minimum of two diffraction peaks. This approach sets the minimum opening angle for the objective aperture of diaphragm.

To analyze the re-imaged beam, we take the amplitude distribution at the output of the crystal, $\phi(r, z_{out})=\phi_0(r, z_{out})+\phi_g(r,z_{out})$; and we propagate the amplitude distribution as spherical wave fronts to the image location. In the absence of aberrations, the objective lens re-images the beam such that the relative accumulated phase at the image plane is 0 and recreates the image, as follows:

$$\phi_i(r, z_{image}) = \frac{1}{M}\int\int F(q)e^{i2\pi q\cdot r}d^2q = \frac{1}{M}\phi(r, z_{out}), \tag{33}$$

where $$F(q) = \int_S \phi_s(r)e^{-i2\pi q\cdot r}d^2r,$$

and $q=k_\perp/k_0=\theta$ is the transverse momentum.

If we include aberrations given by the momentum space pupil function, $H(\theta)=e^{-iW(\theta)}M(\theta)$, where the diaphragm opening, $M(\theta)$, is a step function describing the angle of rays that are collected for the image. The new imaging formulation is expressed as follows:

$$\phi_i(r, z_{image}) = \frac{1}{M}\int\int F(q)e^{i2\pi q\cdot r}H(q)d^2q, \tag{34}$$

which can also be described as a convolution of the source image with the pupil function for the objective lens, $h(r)=F^{-1}\{H(\theta)\}$, which is the inverse Fourier transform of the momentum space pupil function. The amplitude distribution of the re-imaged electron beam is expressed as follows:

$$\phi_i(r, z_{image}) = \frac{1}{M}\phi(r, z_{out})\otimes h(r). \tag{35}$$

Figure 13:
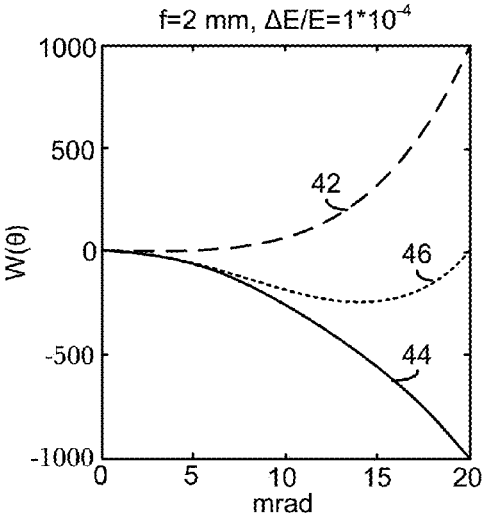
FIG. 13 plots added phase as a function of the angle of electron divergence.
Figure 14:
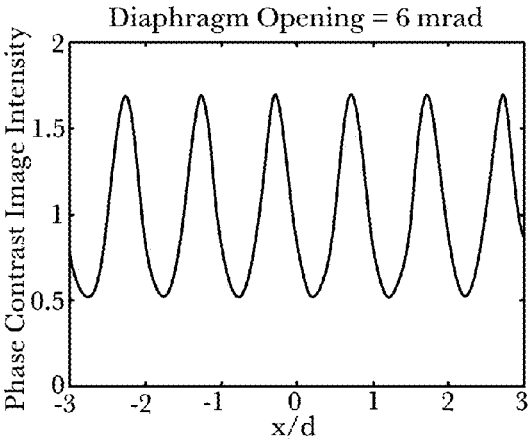
FIG. 14 is a plot of electron population in a phase-contrast image propagated through a lens with a focal length of 2 mm for the initial conditions in FIGS. 4 and 5 with a diaphragm opening of 6 mrad.

The aberrations and imaged electron beam are shown in FIGS. 13 and 14 assuming that the target is placed a distance, $S_1=2f$, from the objective lens. For a thin lens, the image location, $S_2$, is given by $1/S_1+1/S_2=1/f$ and $M=-S_2/S_1$; and for this case, the magnification is 1. In FIG. 13, spherical 42, chromatic 44, and total 46 phase shift, $W(\theta)$, is plotted as a function of the angle of electron divergence.

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties or other values are specified herein for embodiments of the invention, those parameters or values can be adjusted up or down by $1/100^{th}$, $1/50^{th}$, $1/20^{th}$, $1/10^{th}$, $1/5^{th}$, $1/3^{th}$, $1/2^{th}$, $2/3^{rd}$, $3/4^{th}$, $4/5^{th}$, $9/10^{th}$, $19/20^{th}$, $49/50^{th}$, $99/100^{th}$, etc. (or up by a factor of 1, 2, 3, 4, 5, 6, 8, 10, 20, 50, 100, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety; and appropriate components, steps, and characterizations from these references may or may not be included in embodiments of this invention. Still further, the components and steps identified in the Background section are integral to this disclosure and can be used in conjunction with or substituted for components and steps described elsewhere in the disclosure within the scope of the invention. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A method for generating coherent electron current comprising:

generating and transmitting an electron bunch along a longitudinal axis;

directing the electron bunch onto a target, wherein the target imparts a transverse spatial modulation to the electron bunch via at least one of diffraction contrast and phase contrast, and wherein the transverse spatial modulation is orthogonal to the longitudinal axis; and transferring the transverse spatial modulation of the electron bunch to the longitudinal axis via an emittance exchange beamline, creating a periodically modulated distribution of coherent electron current along the longitudinal axis.

2. The method of claim 1, further comprising directing the periodically modulated distribution of electron current into a stream of photons to generate coherent radiation.

3. The method of claim 2, wherein the stream of photons have a periodic distribution matching that of the electron current.

4. The method of claim 2, wherein the coherent radiation is generated by inverse Compton scattering of the electrons on a laser pulse.

5. The method of claim 1, further comprising directing the periodically modulated distribution of electron current into a static magnetic field to generate coherent radiation.

6. The method of claim 5, wherein the coherent radiation is generated in a magnetic undulator.

7. The method of claim 5, wherein the coherent radiation is generated in a dipole magnetic field.

8. The method of claim 1, further comprising accelerating the periodically modulated distribution of coherent electron current.

9. The method of claim 8, wherein the periodically modulated distribution of coherent electron current is accelerated without using a superconducting material.

10. The method of claim 1, wherein the target is a crystal lattice, and wherein the transverse spatial modulation is imparted via phase contrast.

11. The method of claim 10, wherein the crystal lattice has an atomic spacing less than 1 nm.

12. The method of claim 10, wherein the crystal lattice comprises a crystalline material selected from silicon and carbon.

13. The method of claim 1, wherein the target is a grating, and wherein the transverse spatial modulation is imparted via diffraction contrast.

14. The method of claim 13, wherein the grating has a spacing no greater than about 1,000 nm.

15. The method of claim 13, wherein the grating comprises silicon or carbon.

16. The method of claim 1, further comprising at least one of (a) focusing and (b) magnifying the electron bunch before transferring the transverse spatial modulation of the electron bunch to the longitudinal axis.

17. The method of claim 16, further comprising using solenoid magnets and quadrupole magnets to achieve the at least one of (a) focusing ad (b) magnifying the electron bunch.

18. The method of claim 1, wherein the electron bunch is generated by directing photons from a laser onto a cathode.

19. The method of claim 1, wherein the electron bunch is provided by a terahertz acceleration structure.

20. An apparatus for generating coherent electron current comprising:

an electron source configured to emit an electron bunch along a longitudinal axis;

at least one magnet structure selected from a solenoid and quadrupole magnets positioned to receive and to at least one of (a) focus and (b) magnify the electron bunch;

a target positioned to receive the electron bunch from the magnet structure, wherein the target imparts a transverse spatial modulation to the electron bunch via at least one of diffraction contrast and phase contrast; and an emittance exchange beamline positioned and configured to convert a transverse structure of the electron bunch to a longitudinal structure along the longitudinal axis to produce a periodically modulated distribution of coherent electron current.

21. The apparatus of claim 20, further comprising:

an enhancement cavity including optical elements that define an optical path in the enhancement cavity, wherein the enhancement cavity is positioned to receive the periodically modulated distribution of coherent electron current; and a laser positioned and configured to generate photons and to direct the photons into the enhancement cavity for circulation along the optical path in the enhancement cavity where the photons can interact with the periodically modulated distribution of coherent electron current to generate radiation.

22. The apparatus of claim 20, further comprising an accelerator positioned and configured to receive and accelerate the electron bunch, after the transverse spatial modulation, along the longitudinal axis.

* * * * *